US007464925B2

(12) United States Patent
Dobbertin et al.

(10) Patent No.: US 7,464,925 B2
(45) Date of Patent: Dec. 16, 2008

(54) ADJUSTABLE SHEET FEEDER FOR ADJUSTING SHEET STACK CENTER RELATIVE TO SHEET STACK EDGES

(75) Inventors: Michael T. Dobbertin, Honeoye, NY (US); Alan E. Rapkin, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 419 days.

(21) Appl. No.: 11/055,860

(22) Filed: Feb. 11, 2005

(65) Prior Publication Data

US 2005/0212196 A1 Sep. 29, 2005

Related U.S. Application Data

(60) Provisional application No. 60/557,517, filed on Mar. 29, 2004.

(51) Int. Cl.
*B65H 1/08* (2006.01)

(52) U.S. Cl. ..... 271/148; 271/209; 271/161; 271/152; 271/154

(58) Field of Classification Search ..... 271/209, 271/148, 161, 147, 152–155; 493/412; 414/796.7
See application file for complete search history.

(56) References Cited

U.S. PATENT DOCUMENTS

| | | | | |
|---|---|---|---|---|
| 1,685,799 | A | | 10/1928 | Baker |
| 4,400,124 | A | * | 8/1983 | Greller ..... 414/790.2 |
| 4,582,463 | A | * | 4/1986 | Schreiner ..... 414/796.7 |
| 5,074,837 | A | * | 12/1991 | Blanton et al. ..... 493/412 |
| 5,605,528 | A | * | 2/1997 | Larson ..... 493/411 |
| 5,988,629 | A | | 11/1999 | Burlew et al. |
| 6,139,008 | A | | 10/2000 | Margiotta et al. |

FOREIGN PATENT DOCUMENTS

EP 1318090 11/2003

* cited by examiner

*Primary Examiner*—Patrick H Mackey
*Assistant Examiner*—Jeremy Severson
(74) *Attorney, Agent, or Firm*—Donna P. Suchy

(57) ABSTRACT

According to an aspect of the invention an adjustable sheet feeder for use in an apparatus for feeding sheets from the top of a sheet supply stack is shown. The sheet supply stack has a center and marginal edges, each having a top. The adjustable sheet feeder comprises a sheet supply stack support, a sheet feed head assembly, a curl sensing device which senses the position of the stack edges relative to the position of the stack center top and provides feedback, an adjustment device, and a feed back display which displays the curl sensing device feedback. The adjustment device adjusts the position of the stack center top relative to the position of the stack marginal edges top based on the curl sensing device feedback.

10 Claims, 6 Drawing Sheets

ADJUSTABLE SHEET FEEDER FOR ADJUSTING SHEET STACK CENTER RELATIVE TO SHEET STACK EDGES

CROSS REFERENCE TO RELATED APPLICATIONS

This is a 111A application of Provisional Application Ser. No. 60/557,517, filed Mar. 29, 2004, entitled ADJUSTABLE SHEET FEEDER FOR ADJUSTING SHEET STACK CENTER RELATIVE TO SHEET STACK EDGES by Alan E. Rapkin, et al.

BACKGROUND

The present invention is in the field of printers and copiers. Specifically this invention relates to paper supply platforms.

Paper often has what is called curl, which is the edges of the paper not being level with the center of the paper. Moderate curl is adequately handled with present sheet feeders. However, many factors can cause a curl which exceeds that which can be fed reliably. Sensitivity to curl is greatest with very light paper, and very heavy paper.

Further, certain environmental conditions can cause excess curl. When a stack of paper is exposed to a dry environment, the stack dries from the exposed surfaces inward toward the center of the stack. For sheets in the middle of the stack, this results in the edges of the sheets drying first. Since most papers shrink when they dry out, this results in the edges of the sheet being 'smaller' than the center of the sheets which haven't dried out as much. This results in a "dish" curl, or "oilcanning" whereby the sheet deflects out of plane, with edges either rising or falling. When such paper is stacked in a paper supply this generally results in the edges of the paper being higher than the center of the paper due to the weight of the stack in the center. For the most reliable feeding of paper, the center of the paper should be higher than the edges of the paper (in a top feeding vacuum device).

A paper supply tray is desired which would allow for reliable feeding of paper with a wide range of curl, and which preferably would orient all paper with curl such that the center of the paper stack is higher than the edges of the paper stack for the most reliable feeding.

SUMMARY OF THE INVENTION

According to an aspect of the invention an adjustable sheet feeder for use in an apparatus for feeding sheets from the top of a sheet supply stack is shown. The sheet supply stack has a center and marginal edges, each having a top. The adjustable sheet feeder comprises a sheet supply stack support, a sheet feed head assembly, a curl sensing device which senses the position of the stack edges relative to the position of the stack center top and provides feedback, an adjustment device, and a feed back display which displays the curl sensing device feedback. The adjustment device adjusts the position of the stack center top relative to the position of the stack marginal edges top based on the curl sensing device feedback.

DETAILED DESCRIPTION

Figure 1:
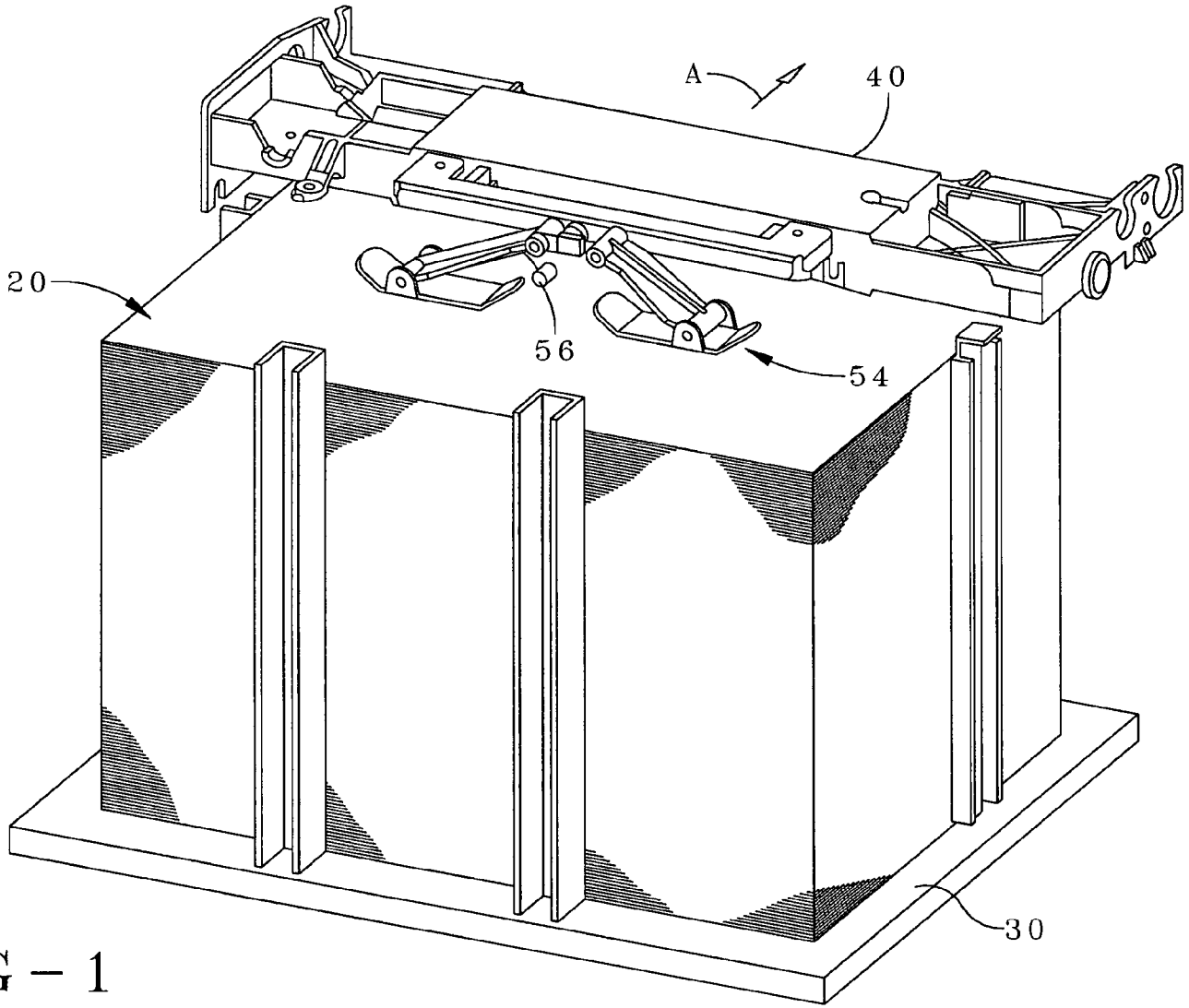
FIG. 1 is an isometric view of an adjustable sheet feeder according to an aspect of the invention.

Various aspects of the invention are presented in FIGS. 1-8 which are not drawn to scale and in which like components are numbered alike. Referring now to these Figures, according to an aspect of the invention an adjustable sheet feeder 10 for use in an apparatus for feeding sheets from the top of a sheet supply stack 20 is shown. The adjustable sheet feeder comprises a sheet supply stack support 30, and a sheet feed head assembly 40. The sheet supply stack 20 has a center 22 and marginal edges 24, each having a top (23 and 25 respectively). The adjustable sheet feeder 10 further comprises a curl sensing device 50, an adjustment device 60, and a feed back display 70.

The curl sensing device 50 senses the position of the stack marginal edges top 25 relative to the position of the stack center top 23, wherein the curl sensing device 50 provides feedback.

The adjustment device 60 adjusts the position of the stack center top 23 relative to the position of the stack marginal edges top 25.

The feedback display 70 displays the curl sensing device 50 feedback, such that adjustments may be made based on the curl sensing device 50 feedback.

Figure 2:
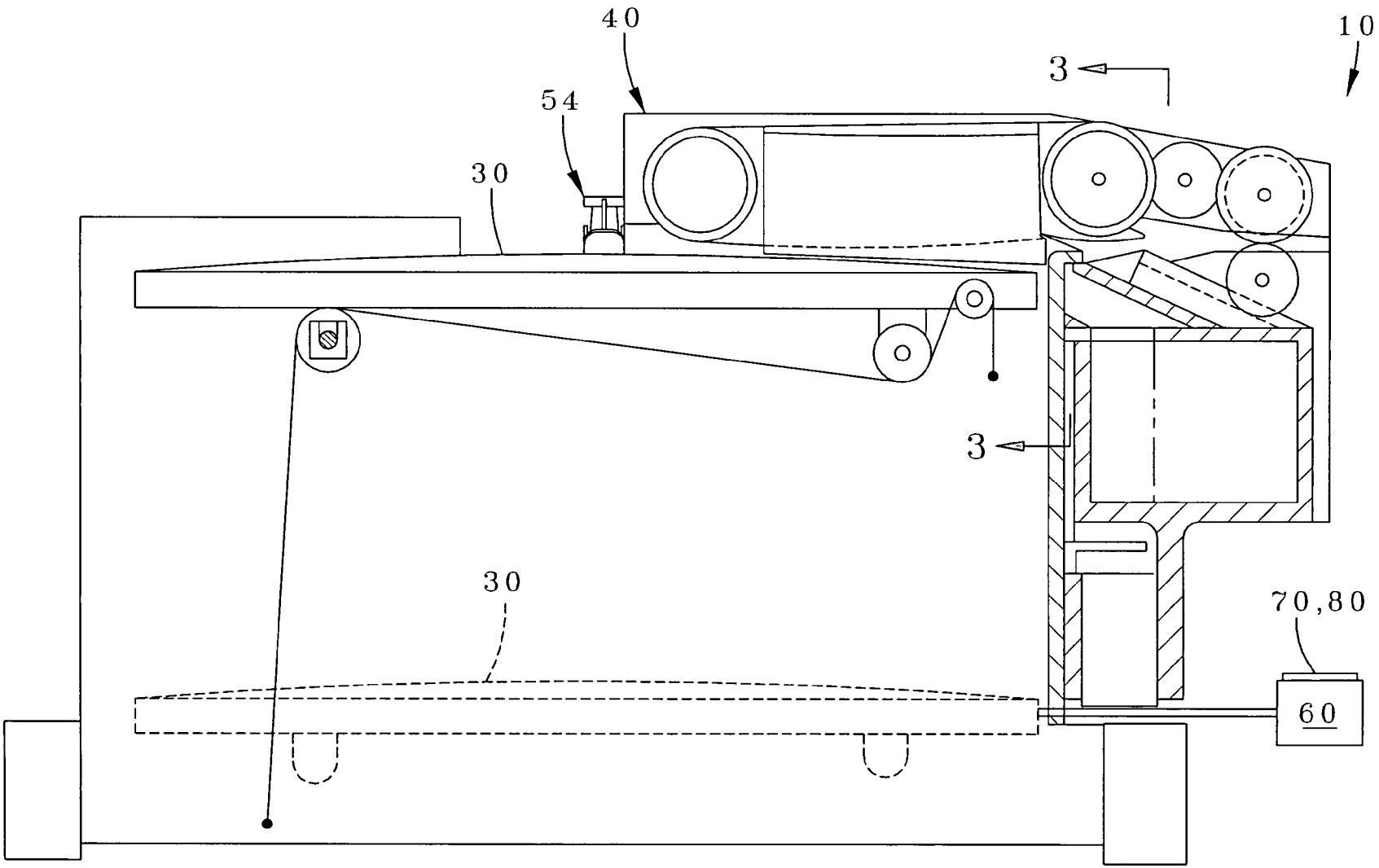
FIG. 2 is a side view of an adjustable sheet feeder, according to an aspect of the invention.
Figure 3:
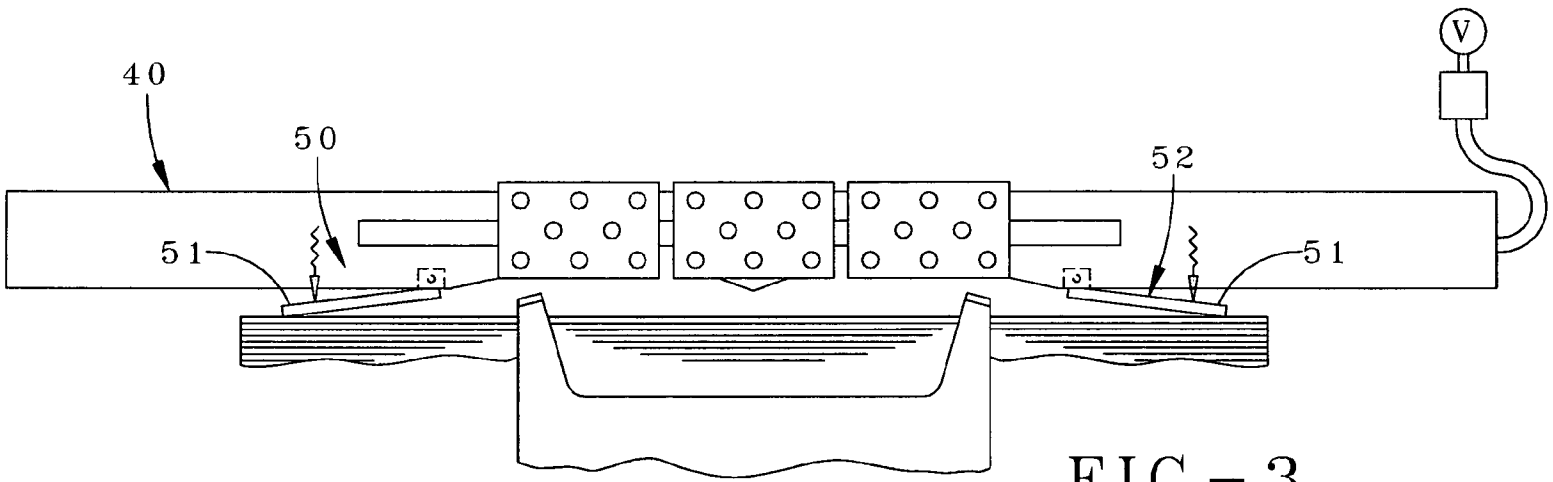
FIG. 3 is a sectional view from FIG. 2 of an adjustable sheet feeder according to an aspect of the invention.

According to a further aspect of the invention, the adjustable sheet feeder 10 further comprises an indicator 80, wherein the indicator 80 signals when the stack center top 23 is not within a predetermined proper operative relation to the marginal edges top 25. Thus an operator of the copier/printer will be alerted when the stack center top 23 is not within a predetermined proper operative relation to the marginal edges top 25, and can make appropriate adjustments. Referring to FIG. 2, the feedback display 70, and indicator 80 are shown attached to the adjustment device 60 for reference. The feed back display 70 and the indicator 80 may be located any convenient place on the apparatus within the operator's view.

In a further aspect of the invention, the feedback display 70 further instructs what adjustments are necessary to cause the stack center top 23 to be within a predetermined proper operative relation to the marginal edges top 25, such that an operator can more accurately and quickly make proper adjustments.

Figure 5:
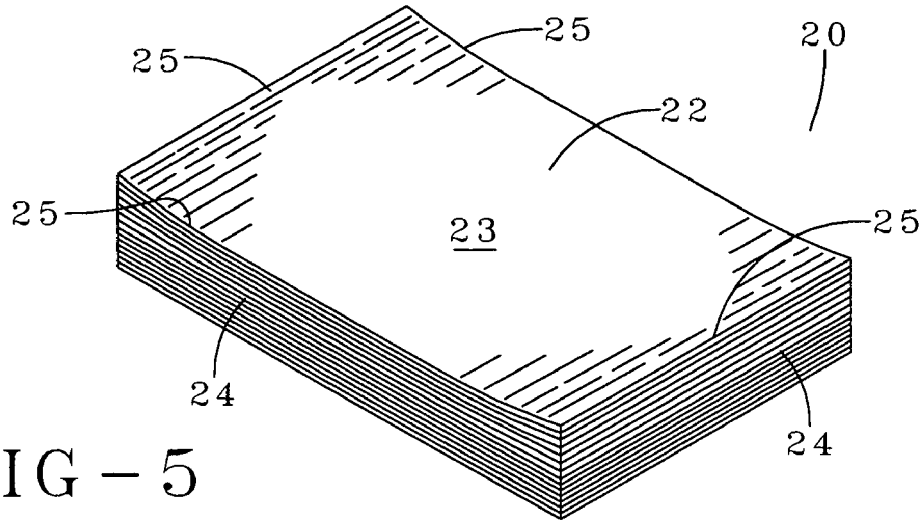
FIG. 5 is an isometric view of a receiver sheet stack according to an aspect of the invention.
Figure 6:
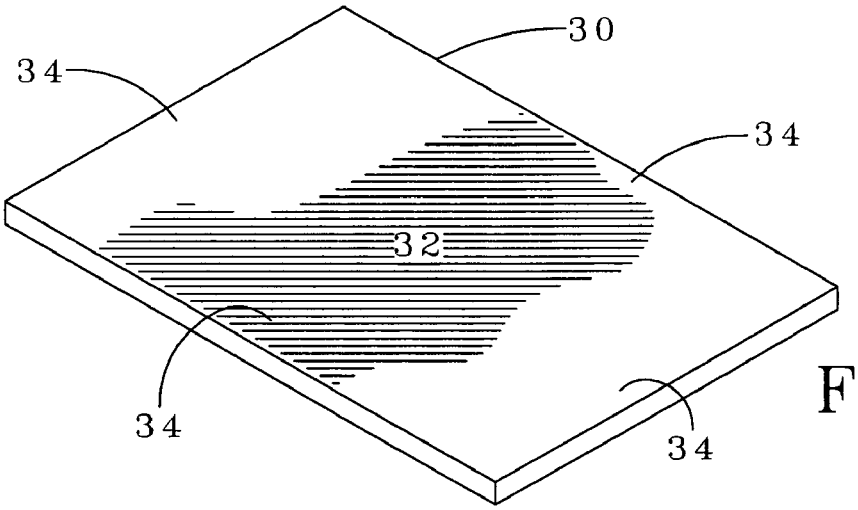
FIG. 6 is an isometric view of a sheet supply stack support according to an aspect of the invention.

Referring now to FIGS. 5 and 6, in a preferred embodiment of the invention, the curl sensing device 50 comprises an edge detection apparatus 52, a center detection apparatus 54, and a signal setting apparatus 56. The edge detection apparatus 52 detects the marginal edges top 25 in the sheet supply stack 20, and produces a signal indicative of the marginal edge top 25 detection. The center detection apparatus 54 detects the sheet supply stack center top 23, and produces a signal indicative of the sheet supply stack center top 23 detection. The signal setting apparatus 56 sets a signal representative of the sheet supply stack center top 23 being in proper operative relation to the sheet marginal edges top 25. A sheet position detection apparatus is described in detail in U.S. Pat. No. 5,988,629, "Control for a Sheet Stack Supporting Platform" by Burlew et al, which is hereby incorporated by reference. With some modifications, this same type of system can be implemented in the present invention to detect the curl of the sheet supply stack.

In a further preferred embodiment of the invention, the edge detection apparatus 52 comprises plates 51 pivotally attached to the feed head assembly 40 so as to be engaged by respective opposed marginal edges top 25 of the sheet supply stack 20. The sheet supply stack coming in contact with the plates 51 would produce an "actuated" signal.

Figure 4:
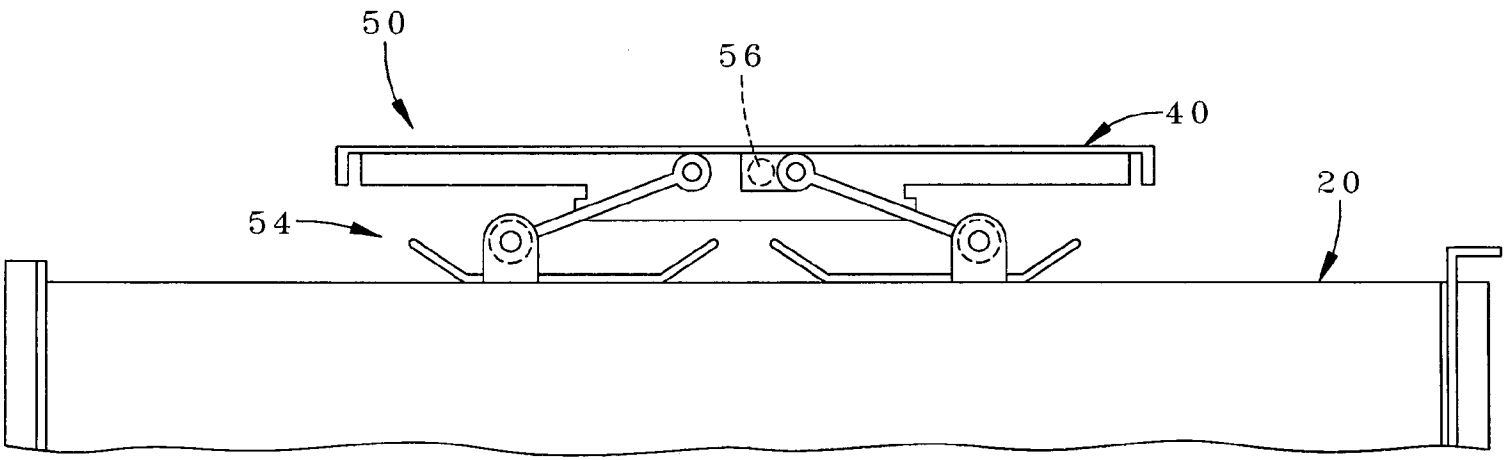
FIG. 4 is a rear elevational view of the apparatus shown in FIG. 1.

According to another aspect of the invention, center detection apparatus 54 comprises an analog sensor which produces a signal which has a value corresponding to the location of the sheet supply stack center top 23 relative to the feed head assembly 40. If an analog sensor is not available, the center detection apparatus 54 may be a digital sensor. FIGS. 1 and 4 show the center detection apparatus 54 as two plate-like members pivotally attached to the feed head assembly 40 and the signal setting apparatus 56. These plates resting on the stack center top 23 would produce an "actuated" signal. The curl can be measured while the sheet supply stack support is raising up to the feed position, by measuring the distance moved between when the center detection apparatus 54 is actuated and the edge detection apparatus 52 is actuated.

According to an aspect of the invention the sheet supply stack support 30 has a center portion 32, and edge portions 34, wherein the center portion 32 is moveable relative to the edge portions 34, and wherein the adjustment device 60 moves the sheet supply stack support center portion 32 relative to the sheet supply stack edge portions 34.

Figure 7:
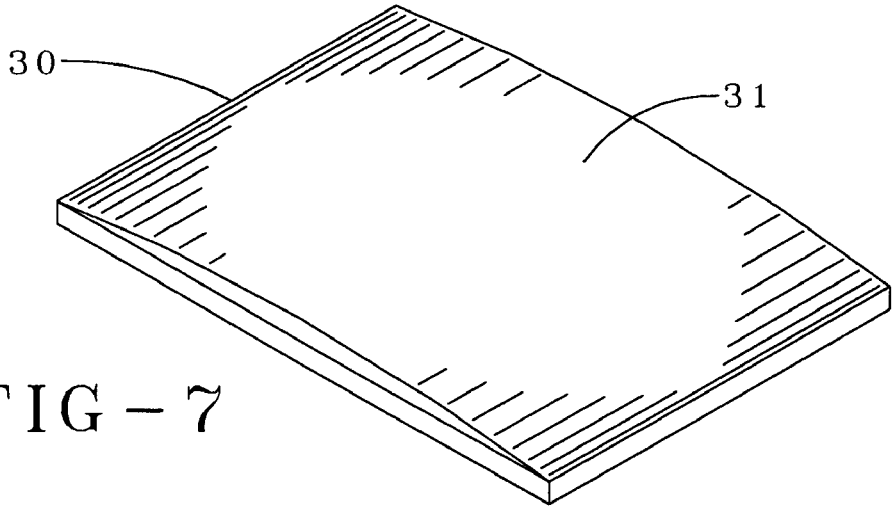
FIG. 7 is an isometric view of a sheet supply stack support according to an aspect of the invention.
Figure 8:
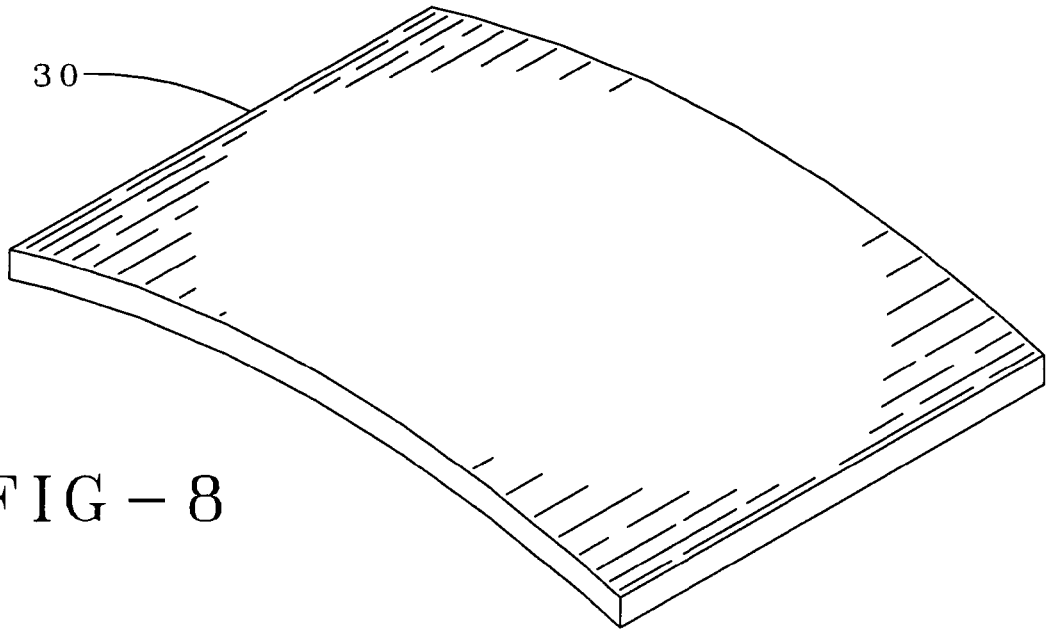
FIG. 8 is an isometric view of a sheet supply stack support according to an aspect of the invention.
Figure 9:
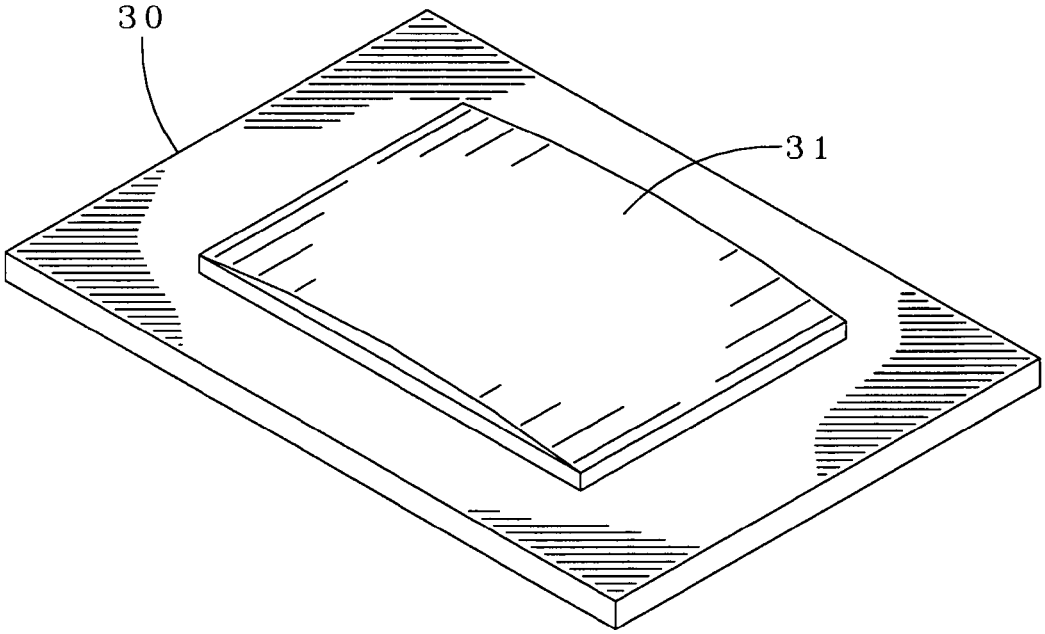
FIG. 9 is an isometric view of a sheet supply stack support according to an aspect of the invention.

According to a further aspect of the invention, the sheet supply stack support 30 comprises an air bladder 31, wherein the adjustment device 60 adjusts the amount of air in the air bladder 31, thus adjusting the position of the stack center top 23 relative to the position of the stack marginal edges top 25. FIGS. 7 and 9 show two typical configurations for the air bladder 31. In FIG. 7, the air bladder 31 is the size of the sheet supply stack support 30, but shaped so that the center portion of the air bladder 31 expands more than the edges. In FIG. 9 the air bladder 31 is smaller than the sheet supply stack support 30, and is located in the center portion 32. These are only two examples of configurations, as any configuration which would raise the center portion of the stack relative to the stack marginal edges is within the purview of this invention.

Figure 10:
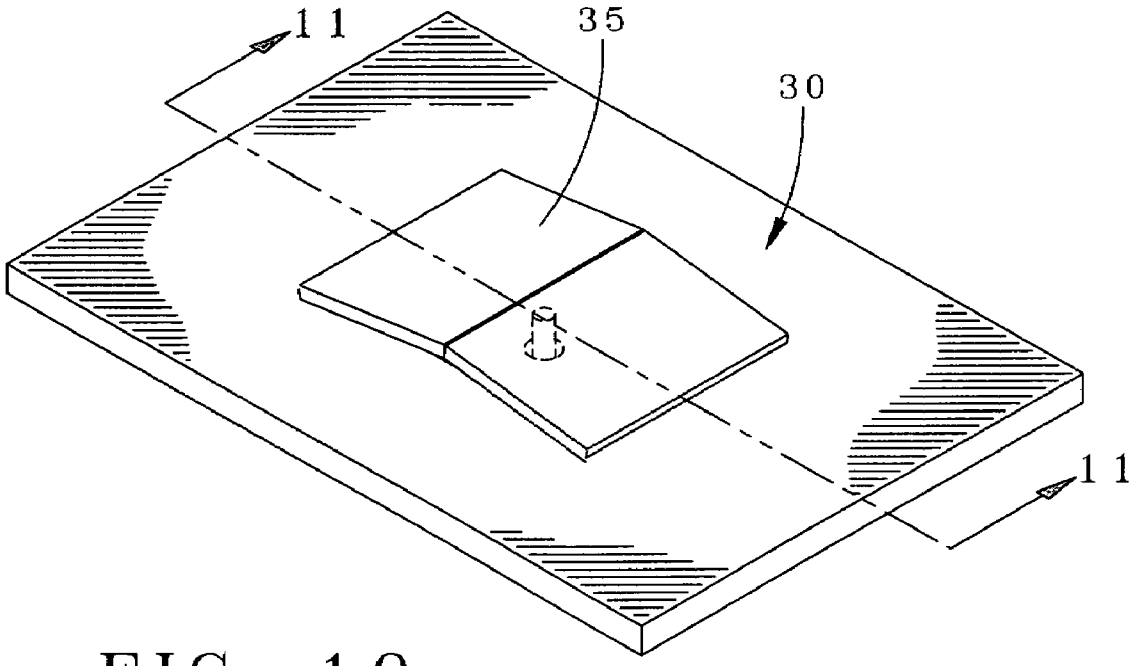
FIG. 10 is an isometric view of a sheet supply stack support according to an aspect of the invention.
Figure 11:
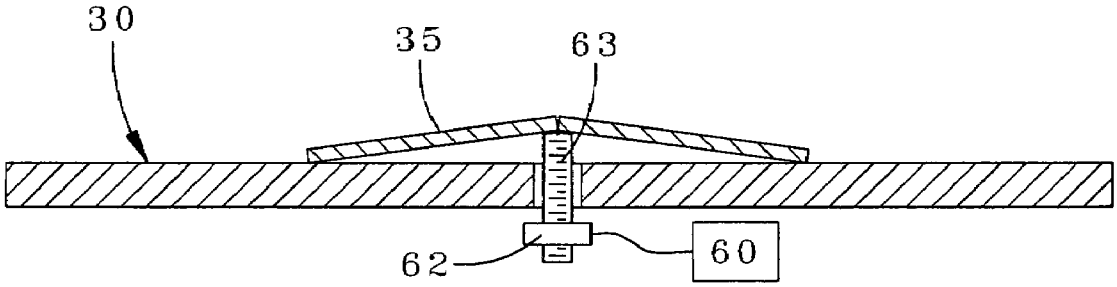
FIG. 11 is a sectional view from FIG. 10 of a sheet supply stack support according to an aspect of the invention.

According to another aspect of the invention the adjustment device 60 comprises a motor driven apparatus which operates to move the sheet supply stack support center portion 32 relative to the sheet supply stack edge portions 34. FIGS. 10 and 11 show the sheet supply stack support 30 as two pieces, wherein the center piece 35 covers the center portion 32 and is hinged perpendicular to the sheet feeding direction. The adjustment device 60 operates a motor 62 which turns the screw 63 to force the hinged portion of the plate 35 upwards, thus moving the sheet supply stack support center portion 32 relative to the sheet supply stack edge portions 34. This is only one example of how the adjustment device might use a motor driven apparatus. The center plate 35 may be planar, and the whole plate may be raised by the motor. The entire sheet supply stack support 30 may be hinged, and raised up in the center by the motor. These and other configurations which would raise the center portion of the stack relative to the stack marginal edges is within the purview of this invention.

In a preferred embodiment of the invention, the adjustable sheet feeder 10 is self-adjusting. The self-adjusting sheet feeder maintains the sheet supply stack 20 such that the sheet supply stack center top 23 is maintained within a predetermined proper operative relation to the sheet supply stack marginal edges top 25. In this embodiment, the curl sensing device 50 feedback is fed into the adjustment device 60 which adjusts the position of the stack center top 23 relative to the position of the stack marginal edges top 25 according to predetermined criteria based on the curl sensing device 50 feedback. Thus if the sheet supply stack support 30 is an air bladder, the adjustment device 60 will control the amount of air in the air bladder such that the sheet supply stack center top 23 is maintained within a predetermined proper operative relation to the sheet supply stack marginal edges top 25. Further, if the adjustment device 60 comprises a motor driven apparatus which operates to move the sheet supply stack support center portion 32 relative to the sheet supply stack edge portions 34, the adjustment device 60 will operate the motor driven apparatus based on the curl sensing device 50 feedback such that the sheet supply stack center top 23 is maintained within a predetermined proper operative relation to the sheet supply stack marginal edges top 25.

If an adjustable sheet feeder is not available or feasible for a particular application, according to another aspect of the invention, the curl may be urged in the best position for feeding by a sheet supply stack support 30 having a center 32 and marginal edges 34, each having a top wherein the sheet supply stack support 30 is shaped such that the center 32 is raised relative to the marginal edges 34. According to a further aspect of the invention, the shape of the sheet supply stack support 30 is convex towards the sheet supply stack 20 (see FIG. 8).

The invention claimed is:

1. An adjustable sheet feeder in an apparatus for feeding sheets from the top of a sheet supply stack, wherein the sheet supply stack has a center having a stack center top, and marginal edges having a stack edges top, the adjustable sheet feeder comprising;

a sheet supply stack support comprising an air bladder, wherein the sheet supply stack support has a center portion and an edge portions, wherein said sheet supply stack center portion is moveable relative to said sheet supply stack support edge portions;

a sheet feed head assembly;

a curl sensing device which operates to sense the position of the stack edges top relative to the position of the stack center top, wherein said curl sensing device provides feedback;

an adjustment device to adjust the position of the stack center top relative to the position of the stack marginal edges top to place the stack center top in a predetermined proper position relative to sheet marginal edges top based on said feedback by moving said said sheet supply stack support center portion relative to said sheet supply stack edge portions by adjusting the amount of air in said air bladder;

an indicator, which operates to signal when the stack center top is not within the predetermined proper position relative to the marginal edges top; and a feedback display, which operates to display said curl sensing device feedback, such that adjustments may be made based on said curl sensing device feedback.

2. The adjustable sheet feeder of claim 1 wherein said curl sensing device comprises:

edge detection apparatus operative to detect said marginal edges top in the sheet supply stack, and producing a signal indicative of said marginal edge top detection;

center detection apparatus operative to detect the location of said sheet supply stack center top, and producing a signal indicative of said sheet supply stack center top location;

signal setting apparatus configured to set a signal representative of said sheet supply stack center top being in proper operative relation to said sheet marginal edges top.

3. The adjustable sheet feeder of claim 2 wherein said edge detection apparatus comprises plates pivotally attached to the feed head assembly so as to be engaged by respective opposed marginal edges of said sheet supply stack.

4. The adjustable sheet feeder of claim 2 wherein said center detection apparatus comprises an analog sensor which produces a signal which has a value corresponding to the location of the top of said sheet supply stack center relative to the feed head assembly.

5. The adjustable sheet feeder of claim 1 wherein said adjustment device comprises a motor driven apparatus operative to move said sheet supply stack support center portion relative to said sheet supply stack edge portion.

6. A self-adjusting sheet feeder in an apparatus for feeding sheets from the top of a sheet supply stack, wherein the apparatus comprises a sheet supply stack support comprising an air bladder, and a sheet feed head assembly, wherein the sheet supply stack has a center and marginal edges wherein said sheet supply stack center is moveable relative to said sheet supply stack support edge, each having a top, wherein the self-adjusting sheet feeder maintains the sheet supply stack such that the stack center top is maintained within a predetermined proper operative relation to the marginal edges top, comprising;

a curl sensing device configured to sense the position of the stack edges relative to the position of the stack center top including sensing that the stack center top is within a predetermined proper operative relation to the marginal edges top, wherein said curl sensing device provides feedback;

an adjustment device which adjusts the position of the stack center top relative to the position of the stack marginal edges by moving said sheet supply stack support center relative to said sheet supply stack edges by adjusting the amount of air in said air bladder, wherein said adjustment device receives feedback from said sensing device, and adjusts the position of the stack center top relative to the position of the stack marginal edges according to predetermined criteria based on said sensing device feedback to place the stack center top in proper operative relation to sheet marginal edges top; and an indicator, wherein said indicator signals when the stack center top is not within a proper operative relation to the marginal edges top.

7. The self-adjusting sheet feeder of claim 6 wherein said sensing device comprises:

edge detection apparatus operative to detect said marginal edges top in the sheet supply stack, and producing a signal indicative of said marginal edge top detection;

center detection apparatus operative to detect the location of said sheet supply stack center top, and producing a signal indicative of said sheet supply stack center top location; and, signal setting apparatus configured to set a signal representative of said sheet supply stack center top being in proper operative relation to said sheet marginal edges top.

8. The self-adjusting sheet feeder of claim 7 wherein said edge detection apparatus comprises plates pivotally attached to the feed head assembly so as to be engaged by respective opposed marginal edges of said sheet supply stack.

9. The self-adjusting sheet feeder of claim 7 wherein said center detection apparatus comprises an analog sensor which produces a signal which has a value corresponding to the location of the top of said sheet supply stack center relative to the feed head assembly.

10. The self-adjusting sheet feeder of claim 6 wherein said adjustment device comprises a motor driven apparatus operative to move said sheet supply stack support center portion until said curl sensing device senses that the stack center top is within a predetermined proper operative relation to the marginal edges top.

* * * * *